US006065631A

United States Patent [19]

Oberhofer et al.

[11] Patent Number: 6,065,631

[45] Date of Patent: May 23, 2000

[54] CLOSURE WITH PRESSURE COMPENSATING VALVE FOR A LIQUID CONTAINER

[76] Inventors: Kurt Oberhofer, Hohenweg 24; Karl Batschied, Eribrunnenweg 1, both of Wilhelmsfeld; Udo Schreiner, Waldstrasse 22, Neckargemünd, all of Germany

[21] Appl. No.: 09/341,326

[22] PCT Filed: Oct. 30, 1998

[86] PCT No.: PCT/DE98/03178

§ 371 Date: Jul. 2, 1999

§ 102(e) Date: Jul. 2, 1999

[87] PCT Pub. No.: WO99/23008

PCT Pub. Date: May 14, 1999

[30] Foreign Application Priority Data

Nov. 3, 1997 [DE] Germany ..... 197 48 365

[51] Int. Cl.[7] ..... B65D 51/16

[52] U.S. Cl. ..... 220/367.1; 220/363; 220/745; 217/99

[58] Field of Search ..... 220/203.04, 203.05, 220/203.06, 233, 239, 269, 360, 361, 363, 366.1, 367.1, 601, 745, 86.1; 217/99

[56] References Cited

U.S. PATENT DOCUMENTS

| | | | |
|---|---|---|---|
| 1,747,873 | 2/1930 | Mastrone . | |
| 4,552,283 | 11/1985 | Poldner | 220/304 |
| 4,595,172 | 6/1986 | Henderson | 220/361 X |
| 4,779,755 | 10/1988 | Harris | 220/203 |
| 5,509,564 | 4/1996 | Knoop | 220/360 |
| 5,697,510 | 12/1997 | Wang et al. | 215/262 |
| 5,799,813 | 9/1998 | Letica | 220/254 |

FOREIGN PATENT DOCUMENTS

| | | |
|---|---|---|
| 0145964 | 6/1985 | European Pat. Off. . |
| 296830 | 2/1916 | Germany . |
| 4219571 | 12/1993 | Germany . |

*Primary Examiner*—Stephen K. Cronin
*Attorney, Agent, or Firm*—Galgano & Burke

[57] ABSTRACT

The closure has a bung-type socket (10) of elastic material which fits sealingly into the filling hole and is provided with a central orifice (18). The valve element (20) of the pressure-compensating valve occupies in the central orifice a clearly defined closed position and a clearly defined pressure-compensating position, between which it can be turned within limits defined by stops. The bung-type socket (10) has a lateral pressure-compensating duct (42), the outside end of which is disposed above the liquid level in the completely filled container. The valve element (20) in pressure-compensating position opens up a flow path from the inside end of the pressure-compensating duct (42) to the upper side of the bung-type socket (10), while in closed position it shuts off the path on the inside, covers it on the outside and seals it tightly on both inside and outside.

10 Claims, 2 Drawing Sheets

CLOSURE WITH PRESSURE COMPENSATING VALVE FOR A LIQUID CONTAINER

BACKGROUND OF THE INVENTION

The invention relates to a closure with pressure-compensating valve for the filling hole of a liquid container, with a bung-type socket of elastic material which fits sealingly into the filling hole and is provided with a central orifice, and with a valve element which can be manually turned into position and which occupies in the central orifice a sealing closed position and a pressure-compensating position, in which the interior of the container is in communication with the atmosphere.

Such a closure is known from German Patent DE 4219571 C2. It has a bung-type socket with alternately larger and smaller axial ventilation grooves along the wall of the central orifice and a valve element with alternately larger and smaller axial ventilation fins along the outside surface. The valve element has closed positions, in which matching grooves and fins are in engagement, and pressure-compensating positions, in which non-matching grooves and fins are in engagement.

When the liquid container is completely filled, the bung-type socket dips with its lower end into the liquid. Actuation of the pressure-compensating valve then has the consequence that liquid emerges from the container. A further disadvantage is that it is difficult to distinguish whether the valve element of the pressure-compensating valve is in one of the plurality of possible closed positions or pressure-compensating positions.

SUMMARY OF THE INVENTION

The object of the invention is to provide a satisfactorily hygienic, simply and safely operable closure of the type cited in the introduction, which is capable of achieving pressure compensation when the container is completely full.

This object is achieved with such a closure by the fact that the bung-type socket has a lateral pressure-compensating duct, the outside end of which is disposed above the liquid level in the completely filled container, that the valve element can be turned within limits defined by stops from a clearly defined closed position to a clearly defined pressure-compensating position and back, and that the valve element in pressure-compensating position opens up a flow path from the inside end of the pressure-compensating duct to the upper side of the bung-type socket, while in closed position it shuts off the path on the inside, covers it on the outside and seals it tightly on both inside and outside.

The clear definition of a closed position and pressure-compensating position and the action of turning the valve element therebetween within limits defined by stops make the closure according to the invention very safe to operate. The positions can be clearly marked, and it is apparent at any time whether the valve element is in closed position or pressure-compensating position. The outside cover and seal of the pressure-compensating flow path when the valve element is in closed position ensure that no residual liquid or rinse liquid can enter the closure during the filling process. The closure therefore satisfies the most stringent hygiene requirements.

In one preferred embodiment, the valve element has an external flange, which fits into a recess of the bung-type socket.

On the bottom of the recess there is provided a groove extending outward from the central orifice. The valve element has a surface groove, which in pressure-compensating position brings the inside end of the pressure-compensating duct into communication with the groove on the bottom of the recess.

In another preferred embodiment, the flange of the valve element is noncircular. In closed position and pressure-compensating position it snaps radially onto the outside of the bung-type socket with a projection. In closed position the projection covers the outside end of the groove on the bottom of the recess.

In another preferred embodiment, the valve element is notched over the circumference. The bung-type socket is provided with a cog, which locates the notch and becomes stopped at the ends thereof, thereby limiting the adjustment angle of the valve element and defining the closed position and pressure-compensating position.

In another preferred embodiment, the portion of the valve element disposed opposite the inside end of the pressure-compensating duct forms in circumferential direction a ramp, which descends in turning direction from closed position to pressure-compensating position. By virtue of this ramp, the initial bias exerted by the seal against the inside end of the pressure-compensating duct is gradually relaxed when the valve element is turned from closed position to pressure-compensating position. This opens up the possibility of smooth, gradual pressure compensation and in particular careful pressure relief, for example before beer is tapped for the first time.

In another preferred embodiment, the closure has an originality-protecting feature, which reveals whether or not the pressure-compensating valve has already been actuated.

In another preferred embodiment, the valve element is provided with a liftable curved handle, which is fastened to the valve element by means of ribs, which break away when the handle is lifted for the first time.

In another preferred embodiment, the curved handle attached to the ribs is flush-mounted in the recess of the bung-type socket. The curved handle is therefore protected from inadvertent actuation, and stackability of the containers is ensured.

In another preferred embodiment, the recess of the bung-type socket has a widened portion, which allows the curved handle to be grasped from underneath.

In another preferred embodiment, the bung-type socket is made in the two-plastic technique from a soft external part and a hard reinforcing ring completely embedded therein.

BRIEF DESCRIPTION OF THE DRAWINGS

The invention will be explained in more detail hereinafter by reference to a practical example illustrated in the drawing, wherein.

DETAILED DESCRIPTION OF THE PREFERRED EMBODIMENTS

Figure 3:
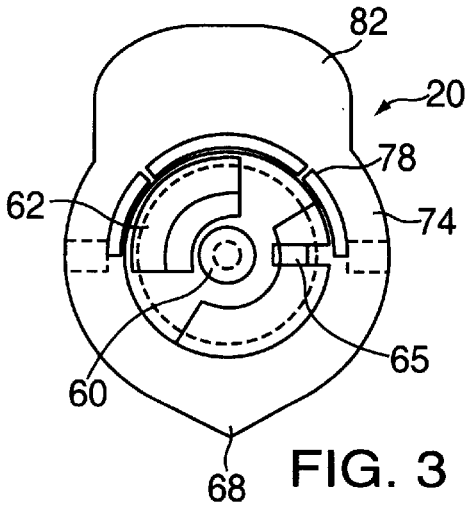
FIG. 3 shows a horizontal projection from below of the valve element seen in direction III of FIG. 1.
Figure 1:
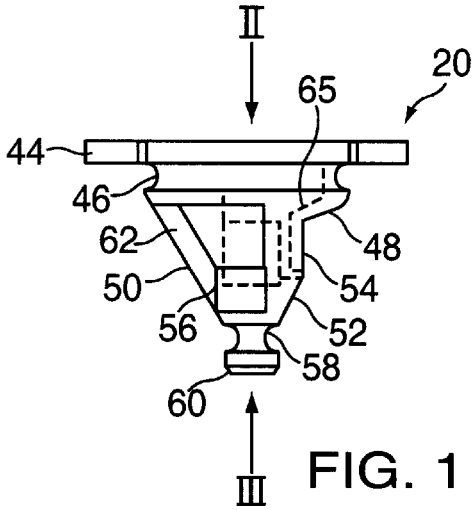
FIG. 1 shows the side view of the valve element of a closure with pressure-compensating valve.
Figure 2:
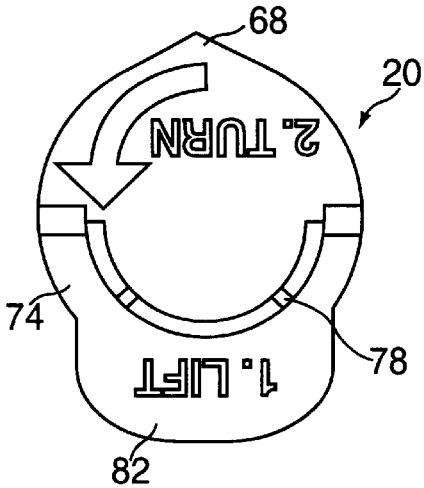
FIG. 2 shows a horizontal projection from above of the valve element seen in direction II of FIG. 1.
Figure 4:
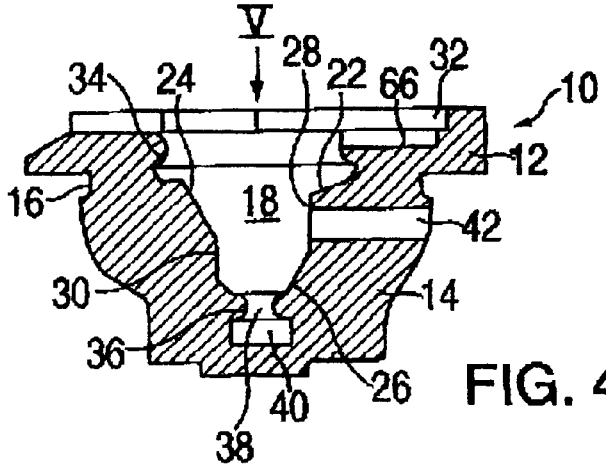
FIG. 4 shows the cross-sectional view through the diameter of a bung-type socket belonging to the closure.
Figure 5:
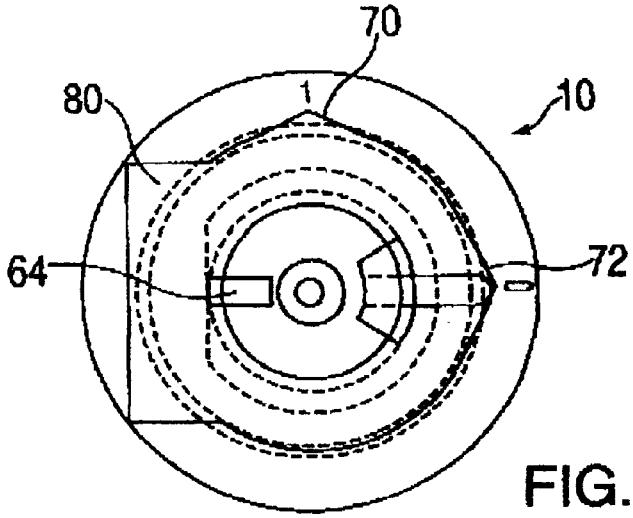
FIG. 5 shows a horizontal projection from above of the bung-type socket seen in direction IV of FIG. 4.
Figure 6:
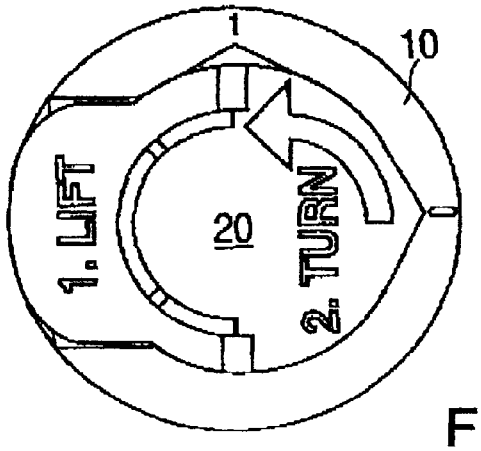
FIG. 6 shows in horizontal projection from above an assembly drawing of bung-type socket and valve element.

The closure described hereinafter functions to close tightly the filling hole of a liquid container. Examples of such containers are kegs, mini-kegs (party kegs) or cans, from which liquids, especially beverages, can be drawn without pressure or under pressure. It is usable in particular for party kegs beer.

The filling hole of such containers is a round hole, which is upwardly open during the filling process. The closure contains a bung-type socket 10 of elastic material, which on the outside is substantially rotationally symmetric relative to its central axis and which has an outwardly protruding flange 12, with which it bears against the outside wall of the container. Bung-type socket 10 projects with a substantially conical tapering portion 14 into the container. The generating line of tapering portion 14 is sigmoidally curved. Between flange 12 and tapering portion 14 the diameter of bung-type socket 10 is recessed to form an annular groove 16, into which the rim of the filling hole fits sealingly when bung-type socket 10 is forced into place.

To dispense liquid, the container has a lower dispensing orifice separate from the filling hole. This can be a bunghole, which is tapped with a tapping fitting or similar device, or a spigot integrated into the container.

Vibrations during transportation and/or warming can cause in beer kegs build-up of considerable overpressure, with the result that almost exclusively foam is tapped at first. It is recommended that this overpressure be carefully relieved before tapping for the first time. For this purpose the bung-type socket is equipped with a manually operated pressure-compensating valve.

When liquid is dispensed from the lower dispensing orifice without pressure, a partial vacuum is produced above the liquid level in the container. To break this partial vacuum, air can be admitted to the container via the pressure-compensating valve.

Bung-type socket 10 has a central orifice 18, in which valve element 20 of the pressure-compensating valve is seated. Valve element 20 is accessible from the outside to allow valve operation. In central orifice 18 of bung-type socket 10 it optionally occupies a sealing closed position or a pressure-compensating position, in which the interior of the container above the liquid level therein is in communication with the atmosphere.

Central orifice 18 of bung-type socket 10 is an inwardly tapering blind hole of basically conical shape, which is not completely axially symmetric but has both conical surface portions 22, 24, 26 and plain cylindrical surface portions 28, 30 distributed over circumference and depth. Valve 20, which is of substantially complementary geometry, thereby has a well-defined mounting position in central orifice 18.

Flange 12 of bung-type socket 10 has on the outside a substantially plain cylindrical recess 32 of large diameter and therebehind, toward the interior of central orifice 18, an annular bead 34, which protrudes radially inward beyond conical surface 22 of central orifice 18. The blind hole ends at the inside in a throat 38 defined by annular bead 36 and a plain cylindrical section 40 of larger diameter.

At surface 28 of the blind hole there extends a pressure-compensating duct 42 in the form of a radial bore, which passes transversely through bung-type socket 10 at approximately half height. Once bung-type socket 10 has been forced into place, the radial bore is disposed above the liquid level in the completely filled container.

Valve element 20 has on the outside a flange 44 which fits into recess 32 of bung-type socket 10. To this there is adjoined on the inside a sealing portion 46 of smaller diameter, into which outer annular bead 34 of bung-type socket 10 snaps. Valve element 20 tapers inwardly with conical surface portions 48, 50, 52 and plain cylindrical surface portions 54, 56 to a neck 58, and ends in a plain cylindrical head 60 of larger diameter. Inner annular bead 36 of bung-type socket 10 snaps into place against neck 58.

Valve element 20 has on the outside surface a notch 62 extending for 90° in circumferential direction. Bung-type socket 10 has on the inside surface a cog 64, which projects into notch 62 and acts as a stop limiting the angle through which valve element 20 can be turned.

The portion of valve element 20 disposed opposite the inside end of pressure-compensating duct 42 forms in circumferential direction a ramp, which descends in the turning direction from closed position to pressure-compensating position.

Valve element 20 has an axial surface groove 65, which extends from the height of the inside end of pressure-compensating duct 42 to the underside of flange 44.

On the bottom of recess 32 of the bung-type socket there is provided a groove 66, which is disposed in the same diametral plane as pressure-compensating duct 42 and which extends from central orifice 18 of bung-type socket 10 to the outside rim of recess 32.

Flange 44 of valve element 20 is noncircular. It has a radially projecting nose 68, which fits into two bulges 70, 72 of recess 32 of the bung-type socket. Thereby the sealing closed position and the pressure-compensating position of valve element 20 are marked and fixed by snap-in effect. Groove 66 on the bottom of recess 32 of the bung-type socket ends in bulge 72 corresponding to pressure-compensating position.

In pressure-compensating position, a flow path between the interior of the container and the atmosphere is opened up via pressure-compensating duct 42, surface groove 65 and groove 66 on the bottom of recess 32. In closed position, the outside end of groove 66 is covered and tightly closed by nose 68 on flange 44 of valve element 20.

From flange 44 of valve element 20, and extending over half the circumference thereof, there is branched off a curved handle 74, which can be lifted by pivoting around a diametral axis 76. Curved handle 74 is fastened to valve element 20 with ribs 78, which break off when the handle is lifted for the first time and form clearly visible fracture faces. Thereby originality protection is achieved.

Curved handle 74 is flush-mounted in recess 32 of the bung-type socket. Recess 32 has a widened portion 80, which extends to the rim of bung-type socket 10 and in which there is disposed a prolongation 82 of the curved handle, which prolongation projects outwardly from flange 44 and can be grasped from underneath at the rim.

While curved handle 74 is lifted, valve element 20 can be turned from closed position to pressure-compensating position and back.

What is claimed is:

1. A closure with pressure-compensating valve for the filling hole of a liquid container, with a bung-type socket of elastic material which fits sealingly into the filling hole and is provided with a central orifice, and with a valve element which can be manually turned into position and which occupies in the central orifice a sealing closed position and a pressure-compensating position, in which the interior of the container is in communication with the atmosphere, characterized in that the bung-type socket (10) has a lateral pressure-compensating duct (42), the outside end of which is disposed above the liquid level in the completely filled container, in that the valve element (20) can be turned within limits defined by stops from a clearly defined closed position to a clearly defined pressure-compensating position and back, and in that the valve element (20) in pressure-compensating position opens up a flow path from the inside end of the pressure-compensating duct (42) to the upper side of the bung-type socket (10), while in closed position it shuts off the path on the inside, covers it on the outside and seals it tightly on both inside and outside.

2. A closure according to claim 1, characterized in that the valve element (20) has an external flange (44) which fits into a recess (32) of the bung-type socket (10), in that on the bottom of the recess (32) there is provided a groove (66) extending outward from the central orifice (18), and in that the valve element (20) has a surface groove (65), which in pressure-compensating position brings the inside end of the pressure-compensating duct (42) into communication with the groove (44) on the bottom of the recess (32).

3. A closure according to claim 1, characterized in that the flange (44) is noncircular and in closed position and pressure-compensating position it snaps radially onto the outside of the bung-type socket (10) with a projection (68), and in that in closed position the projection (68) covers the outside end of the groove (66) on the bottom of the recess (32).

4. A closure according to claim 1, characterized in that the valve element (20) is notched over the circumference, and in that the bung-type socket (10) is provided with a cog (64), which locates the notch (62) and becomes stopped at the ends thereof, thereby limiting the adjustment angle of the valve element (20) and defining the closed position and pressure-compensating position.

5. A closure according to claim 1, characterized in that the portion of the valve element (20) disposed opposite the inside end of the pressure-compensating duct (42) forms in circumferential direction a ramp, which descends in turning direction from closed position to pressure-compensating position.

6. A closure according to claim 1, characterized in that it has an originality-protecting feature, which reveals whether or not the pressure-compensating valve has already been actuated.

7. A closure according to claim 1, characterized in that the valve element (20) is provided with a liftable curved handle (74), which is fastened to the valve element (20) by means of ribs (78), which break away when the handle is lifted for the first time.

8. A closure according to claim 1, characterized in that the curved handle (74) attached to the ribs is flush-mounted in the recess (32) of the bung-type socket (10).

9. A closure according to claim 1, characterized in that the recess (32) of the plug has a widened portion (80), which allows the curved handle (74) to be grasped from underneath.

10. A closure according to claim 1, characterized in that the bung-type socket (10) is made in the two-plastic technique from a soft external part and a hard reinforcing ring completely embedded therein.

* * * * *